US010376898B2

(12) United States Patent
Collins et al.

(10) Patent No.: US 10,376,898 B2
(45) **Date of Patent: *Aug. 13, 2019**

(54) METHOD FOR MANUFACTURING HIGH ASPECT RATIO SILVER NANOWIRES

(71) Applicant: Dow Global Technologies LLC, Midland, MI (US)

(72) Inventors: Raymond M. Collins, Midland, MI (US); Patrick T. McGough, Midland, MI (US); William R. Bauer, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 407 days.

This patent is subject to a terminal disclaimer.

(21) Appl. No.: 15/158,257

(22) Filed: May 18, 2016

(65) Prior Publication Data

US 2016/0361723 A1 Dec. 15, 2016

Related U.S. Application Data

(60) Provisional application No. 62/174,639, filed on Jun. 12, 2015.

(51) Int. Cl.

| | |
|---|---|
| ***B03B 5/66*** | (2006.01) |
| ***B22F 9/24*** | (2006.01) |
| ***B22F 1/00*** | (2006.01) |

(52) U.S. Cl.

CPC ..... *B03B 5/66* (2013.01); *B22F 1/0025* (2013.01); *B22F 9/24* (2013.01)

(58) Field of Classification Search

CPC ..... B03B 5/66; B22F 9/24; B22F 1/0025

See application file for complete search history.

(56) References Cited

U.S. PATENT DOCUMENTS

| | | | |
|---|---|---|---|
| 5,000,848 | A | 3/1991 | Hodgins et al. |
| 5,143,630 | A | 9/1992 | Rolchigo |
| 5,254,250 | A | 10/1993 | Rolchigo et al. |
| 5,944,998 | A | 8/1999 | Rolchigo et al. |
| 5,993,674 | A | 11/1999 | Rolchigo et al. |
| 6,027,656 | A | 2/2000 | Henttonen et al. |
| 6,478,969 | B2 | 11/2002 | Brantley et al. |
| 7,585,349 | B2 | 9/2009 | Xia et al. |
| 7,749,299 | B2 | 7/2010 | Vanheusden et al. |
| 7,922,787 | B2 | 4/2011 | Want et al. |
| 8,314,191 | B2 | 11/2012 | Collins et al. |

(Continued)

FOREIGN PATENT DOCUMENTS

| | | |
|---|---|---|
| CN | 101934378 | 1/2011 |
| CN | 103894624 | 7/2014 |

(Continued)

OTHER PUBLICATIONS

Millipore Corporation, Protein Concentration and Diafiltration by Tangential Flow Filtration, Technical Brief (2003).

(Continued)

*Primary Examiner* — Ellen M McAvoy

(74) *Attorney, Agent, or Firm* — S. Matthew Cairns

(57) ABSTRACT

A method for manufacturing high aspect ratio silver nanowires is provided, wherein the silver solids produced comprise high aspect ratio silver nanowires and are depleted in low aspect ratio silver particles.

10 Claims, 5 Drawing Sheets

(56) References Cited

U.S. PATENT DOCUMENTS

| | | | | |
|---|---|---|---|---|
| 8,541,098 | B2 | 9/2013 | Allemand | |
| 8,648,525 | B2 | 2/2014 | Chiba et al. | |
| 8,727,112 | B2 | 5/2014 | Young et al. | |
| 8,876,937 | B2 | 11/2014 | Peng et al. | |
| 9,034,075 | B2 | 5/2015 | Lunn et al. | |
| 9,776,249 | B2 * | 10/2017 | Wang | B22F 9/24 |
| 9,908,178 | B2 * | 3/2018 | Kim | B22F 9/20 |
| 9,999,926 | B2 * | 6/2018 | McGough | B22F 1/0025 |
| 10,081,020 | B2 * | 9/2018 | Athens | B22F 9/24 |
| 10,081,059 | B2 * | 9/2018 | Ziebarth | B22F 1/004 |
| 2004/0256318 | A1 | 12/2004 | Lida et al. | |
| 2007/0045589 | A1 | 3/2007 | Ittel et al. | |
| 2008/0032047 | A1 | 2/2008 | Parashar et al. | |
| 2009/0242231 | A1 | 10/2009 | Miyagishima et al. | |
| 2009/0311530 | A1 | 12/2009 | Hirai et al. | |
| 2009/0321364 | A1 | 12/2009 | Spaid et al. | |
| 2010/0078197 | A1 | 4/2010 | Miyagishima et al. | |
| 2010/0242679 | A1 | 9/2010 | Yu et al. | |
| 2013/0160608 | A1 | 6/2013 | Nusko et al. | |
| 2013/0255444 | A1 | 10/2013 | Kawaguchi | |
| 2013/0283974 | A1 * | 10/2013 | Lunn | B22F 9/24 75/370 |
| 2013/0334075 | A1 | 12/2013 | Young et al. | |
| 2014/0102254 | A1 * | 4/2014 | Jiang | B22F 1/0025 75/345 |
| 2014/0203223 | A1 | 7/2014 | Ikada et al. | |
| 2014/0224653 | A1 * | 8/2014 | Sun | C09D 139/06 204/403.14 |
| 2014/0231282 | A1 | 8/2014 | Young et al. | |
| 2015/0125592 | A1 | 5/2015 | Arai et al. | |
| 2015/0321257 | A1 * | 11/2015 | Suh | B22F 1/0025 252/514 |
| 2015/0336173 | A1 * | 11/2015 | Kim | C30B 7/14 75/370 |
| 2016/0014393 | A1 | 1/2016 | Kadambi et al. | |
| 2016/0114394 | A1 | 4/2016 | McGough et al. | |
| 2016/0114396 | A1 | 4/2016 | Wang et al. | |
| 2016/0114397 | A1 | 4/2016 | Ziebarth et al. | |

FOREIGN PATENT DOCUMENTS

| | | |
|---|---|---|
| CN | 104511596 | 4/2015 |
| KR | 2013072956 | 7/2013 |
| TW | 201024002 | 7/2010 |
| WO | 2003032084 | 4/2003 |

OTHER PUBLICATIONS

Pradel, et al., Cross-Flow Purification of Nanowires, Angewandte Chemie International Eddition, 50, pp. 3412-3416 (2011).

Korte, et al., Rapid synthesis of silver nanowires through a CuCl- or CuCl2-mediated polyol process, Journal of Materials Chemistry 18, pp. 437-441, (2007).

He, et al., Synthesis and characterization of silver nanowires with zigzag morphology in N,N dimethylformamide, Journal of Solid State Chemistry 180, pp. 2262-2267 (2007).

Zhao, et al., Synthesis and formation mechanism of silver nanowires by a templateless and seedless method, Chemistry Letters, vol. 34, No. 1, pp. 30-31 (2005).

Tang, et al., One-dimensional assemblies of nanoparticles: preparation, properties, and promise, Acvanced Materials 17, No. 8, pp. 951-962 (2005).

Xiong, et al., Formation of silver nanowires through a sandwiched reduction process, Acvanced Materials 15, No. 5, pp. 405-408 (2003).

Sarkar, et al., Effective chemical route for the synthesis of silver nanostructures in formamide, Res. Chem. Intermed 35, pp. 71-78 (2009).

Pastoriza-Santos, et al., Self-assembly of silver particle monolayers on glass from Ag+ solutions in DMG, J. of Colloid and Interface Science 221, pp. 236-241 (2000).

Mdluli, et al., An improved N,N-dimethylformamide and polyvinyl pyrrolidone approach for the synthesis of long silver nanowires, Journal of Alloys and Compounds 469, No. 5, pp. 519-522 (2009).

Walther, et al., Structure-tunable bidirectional hybrid nanowires via multicompartment cylinders, Nano Letters vol. 9, No. 5, 2026-2030 (2009).

Pastoriza-Santos, et al., N,N-Dimethylformamide as a reaction medium for metal nanoparticle synthesis, Advanced Functional Materials 19, pp. 679-688 (2009).

Sun, et al., Polyol synthesis of uniform silver nanowires: a plausible growth mechanism and the supporting evidence, Nano Letters, vol. 3, No. 7, pp. 955-960 (2003).

Wiley, et al., Polyol synthesis of silver nanostructures: control of product morphology with Fe(II) or Fe(III) species, Langmuir, vol. 21, No. 18, pp. 8077-8080 (2005).

Ducamp-Sanguese, et al., Synthesis and characterization of fine monodisperse silver particles of uniform shape 100, pp. 272-280 (1992).

Wiley, et al., Synthesis of silver nanostructures with controlled shapes and properties 40, pp. 1067-1076 (2007).

Giersig, et al., Evidence of an aggregate mechanism during the formation of silver nanowires in N,N-dimethylformamide, J. Mater. Chem. 14, pp. 607-610 (2004).

Zhao et al., Low temperature synthesis and growth mechanism of silver nanowires by a soft-chemistry method, Acta Chimica Sinica, vol. 61, No. 10, pp. 1671-1674 (2003).

Pallavicine, et al., Self-assembled monolayers of silver nanoparticles firmly grafted on glass surfaces: low Ag+ release for an efficient antibacterial activity, J. of Colloid and Interface Science 350, pp. 110-116 (2010).

Pastoriza-Santos, et al., Formation and Stabilization of Silver Nanoparticles through Reduction by N,N-Dimethylformamide, Langmuir 15, pp. 948-951 (1999).

Copending U.S. Appl. No. 15/158,297.

Search report from corresponding Chinese 201610397761.4 application, dated Sep. 20, 2017.

* cited by examiner

METHOD FOR MANUFACTURING HIGH ASPECT RATIO SILVER NANOWIRES

This application claims priority to U.S. Provisional Application No. 62/174,639, filed on Jun. 12, 2015, which is incorporated herein by reference in its entirety.

The present invention relates generally to the field of manufacture of silver nanowires. In particular, the present invention is directed to a method of manufacturing high aspect ratio silver nanowires, wherein the silver solids provided comprise high aspect ratio silver nanowires and are depleted in low aspect ratio silver particles.

Films that exhibit a high conductivity with a high transparency are of great value for use as electrodes or coatings in a wide range of electronic applications, including, for example, touch screen displays and photovoltaic cells. Current technology for these applications involves the use of a tin doped indium oxide (ITO) containing films that are deposited through physical vapor deposition methods. The high capital cost of physical vapor deposition processes has led to the desire to find alternative transparent conductive materials and coating approaches. The use of silver nanowires dispersed as a percolating network has emerged as a promising alternative to ITO containing films. The use of silver nanowires potentially offers the advantage of being processable using roll to roll techniques. Hence, silver nanowires offer the advantage of low cost manufacturing with the potential of providing higher transparency and conductivity than conventional ITO containing films.

Various methods have been proposed for the manufacture of silver nanowires for use in transparent conductive materials. Unfortunately, conventional methods of manufacturing silver nanowires invariably yield polydisperse silver solids, wherein the solids include a mixture of structures including various shapes and sizes. For use in transparent conductive materials; however, it is desirable to provide a uniform suspension of high aspect ratio silver nanowires. The low aspect ratio particles provide negligible contribution to the desired conductive properties of transparent conductive materials, while having a significant detrimental impact on the optical properties of the transparent conductive materials such as haze and transmission.

Conventional methods employed in the effort to separate the low aspect ratio particles from the desired high aspect ratio silver nanowires have proven inadequate.

One alternative approach to this problem has been disclosed by Spaid, et al. in United States Patent Application Publication No. 20090321364. Spaid, et al. disclose a method for separating contaminant particles from a solution containing nanowires; wherein in order to filter the solution containing nanowires, a flow of the solution is generated and directed through a passage defining an aperture having a narrow width or over a micro-structured surface configured to filter the solution.

Notwithstanding, there remains a need for effectively separating low aspect ratio silver particles from high aspect ratio silver nanowires without significant loss of high aspect ratio silver nanowires or significant reduction in the average length of the silver nanowires recovered in the product.

The present invention provides a method of manufacturing high aspect ratio silver nanowires, comprising: providing a raw feed, comprising: a mother liquor; and, silver solids; wherein the silver solids in the raw feed include high aspect ratio silver nanowires and low aspect ratio silver particles; providing a dynamic filtration device, wherein the dynamic filtration device, comprises: a housing, comprising: a cavity having a first side and a second side; wherein there is at least one inlet to the first side of the cavity, at least one product outlet from the first side of the cavity and at least one permeate outlet from the second side of the cavity; and, a porous element disposed within the cavity; a turbulence inducing element disposed within the cavity; and, a pressure source; wherein the porous element is interposed between the first side of the cavity and the second side of the cavity; wherein the porous element has a plurality of passages that traverse from the first side of the cavity to the second side of the cavity; wherein the plurality of passages are large enough to permit transfer of mother liquor and low aspect ratio silver particles and small enough to block transfer of high aspect ratio silver nanowires; wherein the porous element and the turbulence inducing element cooperate to form a filtration gap, FG; and, wherein at least one of the porous element and the turbulence inducing element is moveable; transferring the raw feed to the dynamic filtration device through the at least one inlet to the first side of the cavity; wherein the filtration gap, FG, is filled by the mother liquor; wherein the porous element and the turbulence inducing element disposed within the cavity are both in contact with the mother liquor; pressurizing the first side of the cavity using the pressure source resulting in a first side pressure, $FS_P$, in the first side of the cavity; wherein the first side pressure, $FS_P$, is higher than a second side pressure, $SS_P$, in the second side of the cavity, whereby there is created a pressure drop across the porous element from the first side of the cavity to the second side of the cavity; wherein the pressure source provides a primary motive force for inducing a flow from the first side of the cavity through the porous element to the second side of the cavity providing a permeate; moving at least one of the porous element and the turbulence inducing element whereby a shear stress is generated in the mother liquor in the filtration gap, FG; wherein the shear stress generated in the mother liquor in the filtration gap, FG, operates to reduce fouling of the porous element; withdrawing the permeate from the at least one permeate outlet from the second side of the cavity, wherein the permeate comprises a second part of the mother liquor and a second portion of the silver solids; wherein the second portion of the silver solids is rich in low aspect ratio silver particles; and, withdrawing a product from the at least one product outlet from the first side of the cavity, wherein the product comprises a first part of the mother liquor and a first portion of the silver solids; wherein the first portion of the silver solids is depleted in low aspect ratio silver particles; and, wherein the shear stress generated in the mother liquor in the filtration gap, FG, and the pressure drop across the porous element from the first side of the cavity to the second side of the cavity are decoupled.

DETAILED DESCRIPTION

Figure 1:
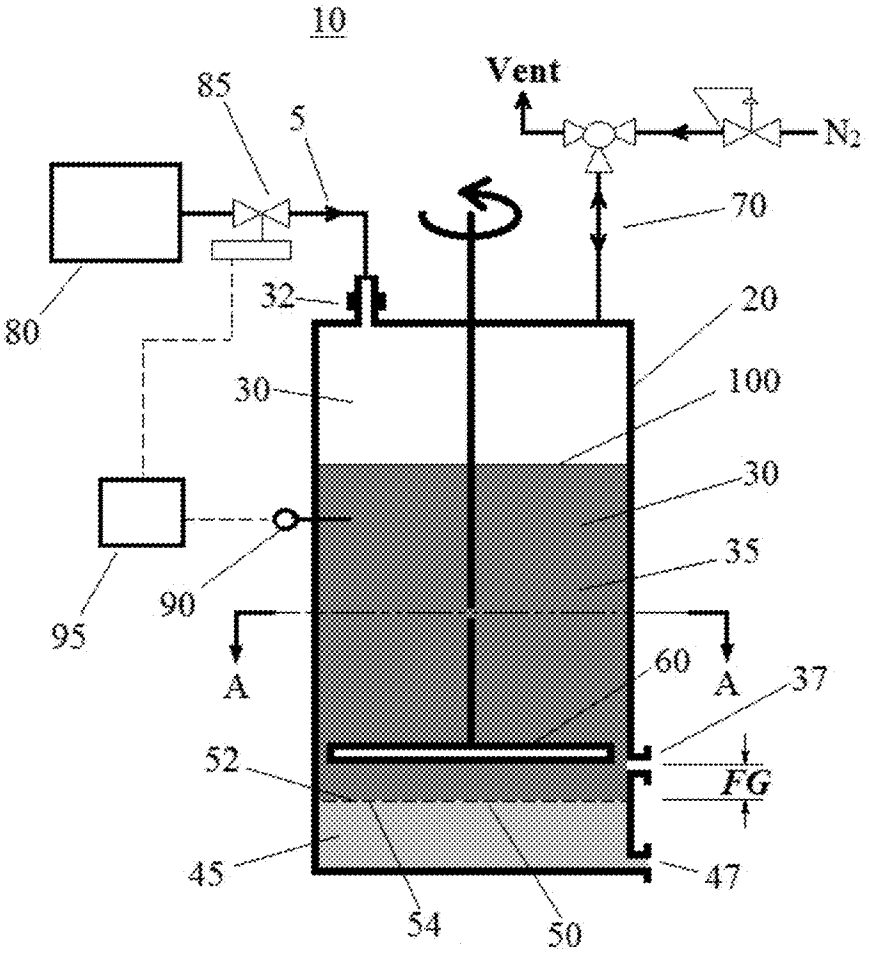
FIG. 1 is a depiction of a dynamic filtration device of the present invention.

A method for manufacturing high aspect ratio silver nanowires has been found which surprisingly provides the effective separation of low aspect ratio silver particles from the silver solids present in a raw feed without significant loss of the desired high aspect ratio silver nanowires or significant reduction in the average length of the silver nanowires recovered in the product.

The term "high aspect ratio silver nanowires" as used herein and in the appended claims refers to silver solids having an aspect ratio >3.

The term "low aspect ratio silver particles" as used herein and in the appended claims refers to silver solids having an aspect ratio of ≤3.

The term "raw weight fraction" or " $WF_{Raw}$" as used herein and in the appended claims means the weight of high aspect ratio silver nanowires in the raw feed divided by the total weight of silver solids contained in the raw feed.

The term "permeate weight fraction" or " $WF_{Permeate}$" as used herein and in the appended claims means the weight of high aspect ratio silver nanowires in the permeate divided by the total weight of silver solids contained in the permeate.

The term "product weight fraction" or " $WF_{Product}$" as used herein and in the appended claims means the weight of high aspect ratio silver nanowires in the product divided by the total weight of silver solids contained in the product.

The term "first side pressure" or "$FS_P$", as used herein and in the appended claims means the pressure measured in the first side (35) of the cavity (30) relative to an atmospheric pressure on the outside of the housing (20).

The term "second side pressure" or "$SS_P$", as used herein and in the appended claims means the pressure measured in the second side (45) of the cavity (30) relative to an atmospheric pressure on the outside of the housing (20).

The term "pressure drop across the porous element" or "$PE_\Delta$" as used herein and in the appended claims means the difference between the first side pressure, $FS_P$, and the second side pressure, $SS_P$, i.e.

$$PE_\Delta = FS_P - SS_P$$

The term "substantially constant " as used herein and in the appended claims in reference to the cross sectional area, $X_{area}$, of a passage (55) through a porous element (50) means that the largest cross sectional area, ${}_LX_{area}$, exhibited by the given passage perpendicular to the flow of permeate through the thickness, T, of the porous element (55) is within 20% of the smallest such cross sectional area ${}_SX_{area}$, exhibited by the passage.

The term "substantially perpendicular" as used herein and in the appended claims in reference to an axis of symmetry, $axis_{sym}$, of a passage (55) through a porous element (50) means that the axis of symmetry, $axis_{sym}$, intersects the top surface (52) of the porous element (50) at an angle, γ, of 85 to 95°.

Preferably, the method of manufacturing high aspect ratio silver nanowires of the present invention, comprises: providing a raw feed (5), comprising: a mother liquor; and, silver solids; wherein the silver solids in the raw feed (5) include high aspect ratio silver nanowires and low aspect ratio silver particles (preferably, wherein the raw feed has a raw weight fraction, $WF_{Raw}$); providing a dynamic filtration device (10), wherein the dynamic filtration device (10), comprises: a housing (20), comprising: a cavity (30) having a first side (35) and a second side (45); wherein there is at least one inlet (32) to the first side (35) of the cavity (30), at least one outlet (37) from the first side (35) of the cavity (30) and at least one outlet (47) from the second side (45) of the cavity (30); and, a porous element (50) disposed within the cavity (30); a turbulence inducing element (60) disposed within the cavity (30); and, a pressure source (70); wherein the porous element (50) is interposed between the first side (35) of the cavity (30) and the second side (45) of the cavity (30); wherein the porous element (50) has a plurality of passages (55) that traverse from the first side (35) of the cavity (30) to the second side (45) of the cavity (30); wherein the plurality of passages (55) are large enough to permit transfer of mother liquor and low aspect ratio silver particles and small enough to block transfer of high aspect ratio silver nanowires; wherein the porous element (50) and the turbulence inducing element (60) cooperate to form a filtration gap (FG); and, wherein at least one of the porous element (50) and the turbulence inducing element (60) is moveable; transferring the raw feed (5) to the dynamic filtration device (10) through the at least one inlet (32) to the first side (35) of the cavity (30); wherein the filtration gap (FG) is filled by the mother liquor; wherein the porous element (50) and the turbulence inducing element (60) disposed within the cavity (30) are both in contact with the mother liquor; pressurizing the first side (35) of the cavity (30) using the pressure source (70) resulting in a first side pressure, $FS_P$, in the first side (35) of the cavity (30); wherein the first side pressure, $FS_P$, is higher than a second side pressure, $SS_P$, in the second side (45) of the cavity (30), whereby there is created a pressure drop ($PE_\Delta$) across the porous element (50) from the first side (35) of the cavity (30) to the second side (45) of the cavity (30); wherein the pressure source (70) provides a primary motive force for inducing a flow from the first side (35) of the cavity (30) through the porous element (50) to the second side (45) of the cavity (30) providing a permeate; moving (preferably, continuously moving) at least one of the porous element (50) and the turbulence inducing element (60) whereby a shear stress is generated in the mother liquor in the filtration gap (FG); wherein the shear stress generated in the mother liquor in the filtration gap (FG) operates to reduce fouling of the porous element (50); withdrawing the permeate from the at least one outlet (47) from the second side (45) of the cavity (30), wherein the permeate comprises a second part of the mother liquor and a second portion of the silver solids; wherein the second portion of the silver solids is rich in low aspect ratio silver particles (preferably, wherein the permeate has a permeate weight fraction, $WF_{Permeate}$); preferably, wherein $WF_{Raw} > WF_{Permeate}$; more preferably, wherein $WF_{Raw} > WF_{Permeate} \leq 0.05$; still more preferably, wherein $WF_{Raw} > WF_{Permeate} \leq 0.01$; most preferably, $WF_{Raw} > WF_{Permeate} \leq 0.001$); and, withdrawing a product from the at least one outlet (37) from the first side (35) of the cavity (30), wherein the product comprises a first part of the mother liquor and a first portion of the silver solids; wherein the first portion of the silver solids is depleted in low aspect ratio silver particles (preferably, wherein the product has a product weight fraction, $WF_{Product}$; preferably, wherein $WF_{Raw} < WF_{Product}$; more preferably, wherein $WF_{Raw} < WF_{Product} \geq 0.8$; still more preferably, wherein $WF_{Raw} < WF_{Product} \geq 0.85$; most preferably, wherein $WF_{Raw} < WF_{Product} \geq 0.9$); wherein the shear stress generated in the mother liquor in the filtration gap (FG) and the pressure drop ($PE_\Delta$) across the porous element (50) from the first side (35) of the cavity (30) to the second side (45) of the cavity (30) are decoupled (i.e., independently controllable). (See FIG. 1).

Preferably, in the method of manufacturing high aspect ratio silver nanowires of the present invention, the raw feed (5) provided, comprises: a mother liquor; and, silver solids; wherein the silver solids are suspended in the mother liquor. Preferably, the raw feed contains <2 wt % silver solids. More preferably, raw feed contains 0.01 to 1 wt % (still more preferably, 0.05 to 0.75 wt %; most preferably, 0.1 to 0.5 wt %) silver solids.

Preferably, in the method of manufacturing high aspect ratio silver nanowires of the present invention, the mother liquor in the raw feed is a liquid. More preferably, the mother liquor in the raw feed is a liquid selected from the group consisting of water and a polyol. Still, more preferably, the mother liquor in the raw feed is a liquid selected from the group consisting of water, diethylene glycol and ethylene glycol. Most preferably, the mother liquor in the raw feed is water. Preferably, the mother liquor in the raw feed is water, wherein the water is at least one of deionized and distilled to limit incidental impurities. More preferably, the mother liquor in the raw feed is water, wherein the water is deionized and distilled. Most preferably, the mother liquor in the raw feed is water, wherein the water is at is ultrapure water that meets or exceeds the Type 1 water requirements according to ASTM D1193-99e1 (Standard Specification for Reagent Water).

Preferable, in the method of manufacturing high aspect ratio silver nanowires of the present invention, the silver solids contained in the raw feed include high aspect ratio silver nanowires and low aspect ratio silver particles. Preferably, wherein the raw feed has a raw weight fraction, $WF_{Raw}$, of high aspect ratio silver nanowires to low aspect ratio silver particles. Preferably, the raw weight fraction, $WF_{Raw}$, is maximized through the process used to synthesize the high aspect ratio silver nanowires. Nevertheless, the synthesis of high aspect ratio silver nanowires invariably yields some amount of undesirable low aspect ratio silver particles that are desirably removed such that the product weight fraction, $WF_{Product}>WF_{Raw}$.

Preferably, in the method of manufacturing high aspect ratio silver nanowires of the present invention, the raw feed provided, further comprises: at least one of a polyvinyl pyrrolidone, a reducing sugar, a reducing agent, a source of copper (II) ions and a source of halide ions. More preferably, the method of manufacturing high aspect ratio silver nanowires of the present invention, the raw feed provided, further comprises: a polyvinyl pyrrolidone and a reducing sugar. Most preferably, the method of manufacturing high aspect ratio silver nanowires of the present invention, the raw feed provided, further comprises: a polyvinyl pyrrolidone, a reducing sugar, a reducing agent, a source of copper (II) ions and a source of halide ions.

Preferably, the polyvinyl pyrrolidone (PVP), incorporated in the raw feed provided in the method of manufacturing high aspect ratio silver nanowires of the present invention, has a weight average molecular weight, Mw, of 20,000 to 300,000 Daltons. More preferably, the polyvinyl pyrrolidone (PVP) has a weight average molecular weight, Mw, of 30,000 to 200,000 Daltons. Most preferably, the polyvinyl pyrrolidone (PVP) has a weight average molecular weight, Mw, of 40,000 to 60,000 Daltons.

Preferably, the reducing sugar, incorporated in the raw feed provided in the method of manufacturing high aspect ratio silver nanowires of the present invention, is selected from the group consisting of at least one of aldoses (e.g., glucose, glyceraldehyde, galactose, mannose); disaccharides with a free hemiacetal unit (e.g., lactose and maltose); and ketone bearing sugars (e.g., fructose). More preferably, the reducing sugar is selected from the group consisting of at least one of an aldose, lactose, maltose and fructose. Still more preferably, the reducing sugar is selected from the group consisting of at least one of glucose, glyceraldehyde, galactose, mannose, lactose, fructose and maltose. Most preferably, the reducing sugar is D-glucose.

Preferably, the reducing agent, incorporated in the raw feed provided in the method of manufacturing high aspect ratio silver nanowires of the present invention, is selected from the group consisting of ascorbic acid; borohydride salts (e.g., $NaBH_4$, $KBH_4$, $LiBH_4$, $Ca(BH_4)_2$); hydrazine; salts of hydrazine; hydroquinone; $C_{1-5}$ alkyl aldehyde and benzaldehyde. More preferably, the reducing agent is selected from the group consisting of ascorbic acid, sodium borohydride ($NaBH_4$), potassium borohydride ($KBH_4$), lithium borohydride ($LiBH_4$), calcium borohydride ($Ca(BH_4)_2$), hydrazine, salts of hydrazine, hydroquinone, acetaldehyde, propionaldehyde and benzaldehyde. Most preferably, the reducing agent is at least one of ascorbic acid and sodium borohydride.

Preferably, the source of copper (II) ions, incorporated in the raw feed provided in the method of manufacturing high aspect ratio silver nanowires of the present invention, is selected from the group consisting of at least one of $CuCl_2$ and $Cu(NO_3)_2$. More preferably, the source of copper (II) ions is selected from the group consisting of $CuCl_2$ and $Cu(NO_3)_2$. Most preferably, the source of copper (II) ions is $CuCl_2$, wherein the $CuCl_2$ is a copper (II) chloride dihydrate.

Preferably, the source of halide ions, incorporated in the raw feed provided in the method of manufacturing high aspect ratio silver nanowires of the present invention, is selected from the group consisting of at least one of a source of chloride ions, a source of fluoride ions, a source of bromide ions and a source of iodide ions. More preferably, the source of halide ions is selected from the group consisting of at least one of a source of chloride ions and a source of fluoride ions. Still more preferably, the source of halide ions is a source of chloride ions. Most preferably, the source of halide ions is a source of chloride ions, wherein the source of chloride ions is an alkali metal chloride. Preferably, the alkali metal chloride is selected from the group consisting of at least one of sodium chloride, potassium chloride and lithium chloride. More preferably, the alkali metal chloride is selected from the group consisting of at least one of sodium chloride and potassium chloride. Most preferably, the alkali metal chloride is sodium chloride.

Preferably, the method of manufacturing high aspect ratio silver nanowires of the present invention, further comprises: providing a transport fluid; and, transferring a volume of the transport fluid to the dynamic filtration device through the at least one inlet to the first side of the cavity. Preferably, the volume of transport fluid can be transferred to the dynamic filtration device in a manner selected from at least one of a single shot, a plurality of shots (wherein the shots can contain the same amount or different amounts of the transport fluid) and continuously. More preferably, the method of manufacturing high aspect ratio silver nanowires of the present invention, further comprises: providing a transport fluid; and, transferring a volume of the transport fluid to the dynamic filtration device through the at least one inlet to the first side of the cavity; wherein a concentration of the silver solids in the first side of the cavity is controlled by adjusting the volume of the transport fluid transferred to the first side of the cavity. Most preferably, the method of manufacturing high aspect ratio silver nanowires of the present invention, further comprises: providing a transport fluid; and, transferring a volume of the transport fluid to the dynamic filtration device through the at least one inlet to the first side of the cavity; wherein the concentration of the silver solids in the first side of the cavity is maintained at ≤2 wt %. More preferably, the volume of transport fluid transferred to the dynamic filtration device is controlled such that the concentration of the silver solids in the first side of the cavity is maintained at 0.01 to 1 wt % (still more preferably, 0.05 to 0.75 wt %; most preferably, 0.1 to 0.5 wt %).

Preferably, in the method of manufacturing high aspect ratio silver nanowires of the present invention, the transport fluid comprises a liquid. More preferably, the transport fluid comprises a liquid selected from the group consisting of water and a polyol. Still, more preferably, the transport fluid comprises a liquid selected from the group consisting of water, diethylene glycol and ethylene glycol. Most preferably, the transport fluid comprises water.

Preferably, in the method of manufacturing high aspect ratio silver nanowires of the present invention, the transport fluid provided, further comprises: at least one of a polyvinyl pyrrolidone, a reducing sugar, a reducing agent, a source of copper (II) ions and a source of halide ions. More preferably, the method of manufacturing high aspect ratio silver nanowires of the present invention, the transport fluid provided, further comprises: a polyvinyl pyrrolidone. Still more preferably, the method of manufacturing high aspect ratio silver nanowires of the present invention, the transport fluid provided, further comprises: a polyvinyl pyrrolidone and a reducing sugar. Most preferably, the method of manufacturing high aspect ratio silver nanowires of the present invention, the transport fluid provided, further comprises: a polyvinyl pyrrolidone, a reducing sugar, a reducing agent, a source of copper (II) ions and a source of halide ions.

Preferably, in the method of manufacturing high aspect ratio silver nanowires of the present invention, the raw feed (5) is transferred to the dynamic filtration device using a fluid mover (80). One of ordinary skill in the art will be able to select an appropriate fluid mover (80) for use with the raw feed. Preferably, in the method of manufacturing high aspect ratio silver nanowires of the present invention, the fluid mover (80) used to transfer the raw feed (5) to the dynamic filtration device (10) is decoupled from the driving force used to induce a pressure drop ($PE_{\Delta}$) across the porous element (50) from the first side (35) of the cavity (30) in the dynamic filtration device (10) to the second side (45) of the cavity (30). More preferably, the raw feed is transferred to the dynamic filtration device (10) using a low shear fluid mover (80), such as a peristaltic pump or a system head pressure (e.g., gravity or inert gas pressure). Preferably, when a system head pressure is used as the fluid mover (80) to facilitate the transfer of raw feed (5) to the dynamic filtration device (40), the fluid mover (80) further comprises a fluid valve (85) (preferably a fluid control valve) to regulate the rate at which raw feed (5) is transferred to the dynamic filtration device (10). (See FIG. 1).

Preferably, the method of manufacturing high aspect ratio silver nanowires of the present invention, further comprises: providing a liquid level sensor (90) and control circuit (95), wherein the liquid level sensor (90) and control circuit (95) are integrated with the dynamic filtration device (10) and the fluid mover (80) (preferably, a peristaltic pump or a system head pressure coupled with a control valve (85)) to maintain a stable liquid level (100) in the housing (20) such that the filtration gap (FG) remains filled by the mother liquor. (See FIG. 1).

Figure 5:
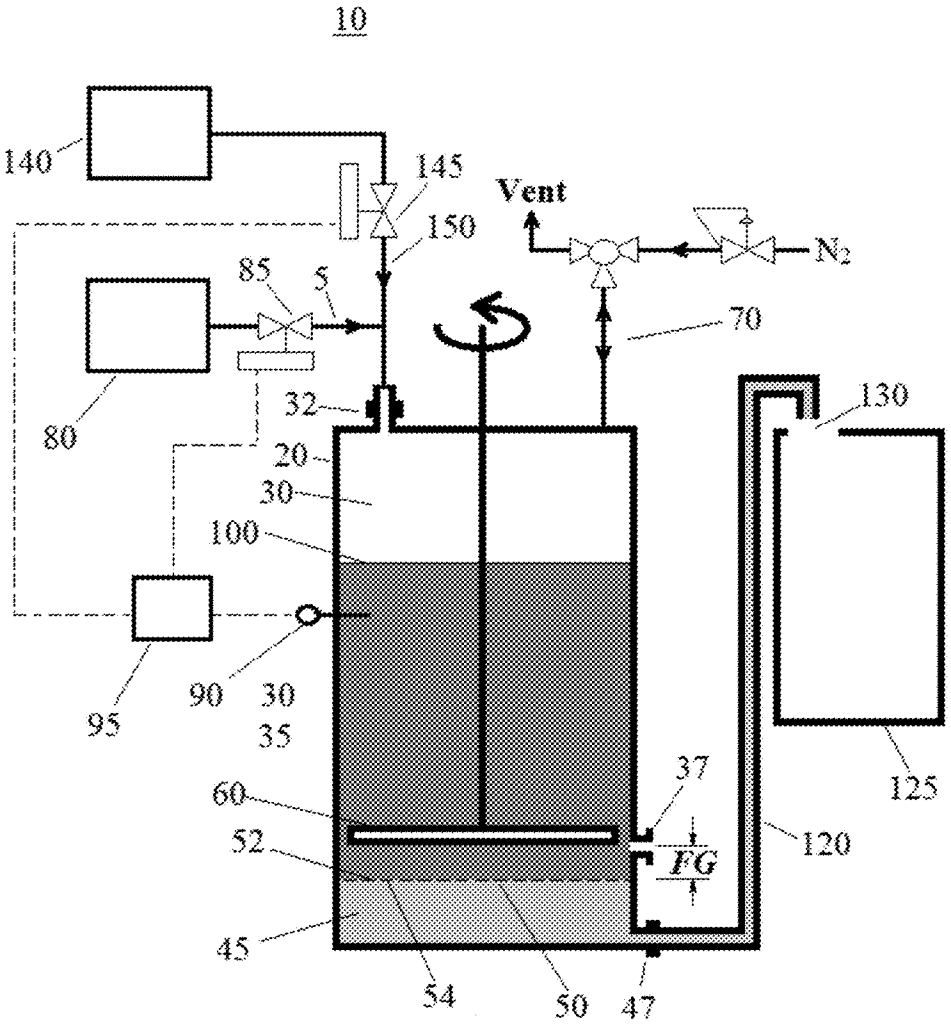
FIG. 5 is a depiction of a dynamic filtration device of the present invention with an associated permeate container and transport fluid components.

Preferably, in the method of manufacturing high aspect ratio silver nanowires of the present invention, the volume (150) of the transport fluid is transferred to the dynamic filtration device (10) using a liquid mover (140). One of ordinary skill in the art will be able to select an appropriate liquid mover (140) for use with the transport fluid. Preferably, in the method of manufacturing high aspect ratio silver nanowires of the present invention, the liquid mover (140) used to transfer the volume (150) of the transport fluid to the dynamic filtration device (10) is decoupled from the driving force used to induce a pressure drop ($PE_{\Delta}$) across the porous element (50) from the first side (35) of the cavity (30) in the dynamic filtration device (10) to the second side (45) of the cavity (30). More preferably, the volume of the transport fluid is transferred to the dynamic filtration device (10) using a pump or a system head pressure (e.g., gravity or inert gas pressure). Preferably, the dynamic filtration device (10) further comprises a liquid valve (145) (preferably a liquid control valve (145)) to regulate the transfer of transport fluid to the dynamic filtration device (10). (See FIG. 5).

Preferably, the method of manufacturing high aspect ratio silver nanowires of the present invention, further comprises: providing a liquid level sensor (90) and control circuit (95), wherein the liquid level sensor (90) and control circuit (95) (preferably, wherein the control circuit includes a programmable logic controller) are integrated with the dynamic filtration device (10), the fluid mover (80) (preferably, a peristaltic pump or a system head pressure coupled with a fluid control valve (85)), and a liquid control valve (145) to maintain a stable liquid level (100) in the housing (20) such that the filtration gap (FG) remains filled by the mother liquor. (See FIG. 5).

Figure 2:
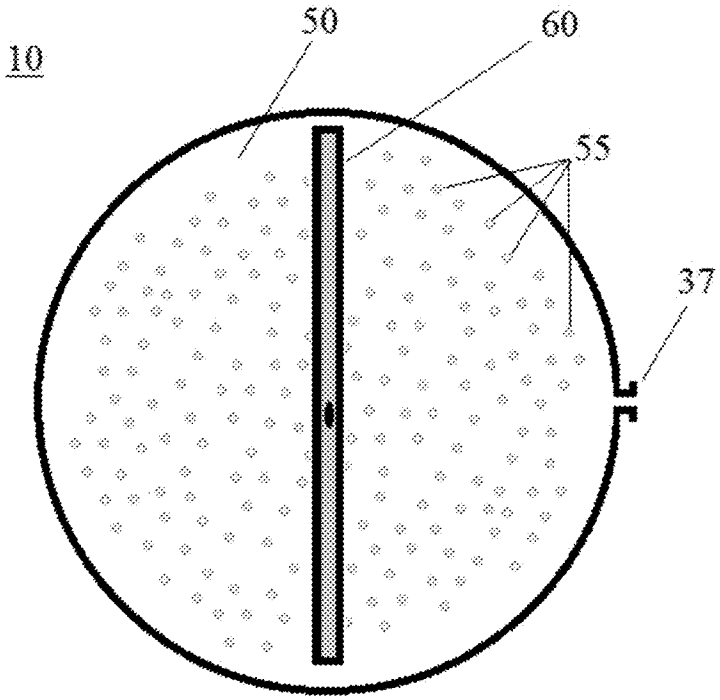
FIG. 2 is a depiction of a cross sectional view taken along line A-A in FIG. 1.
Figure 3:
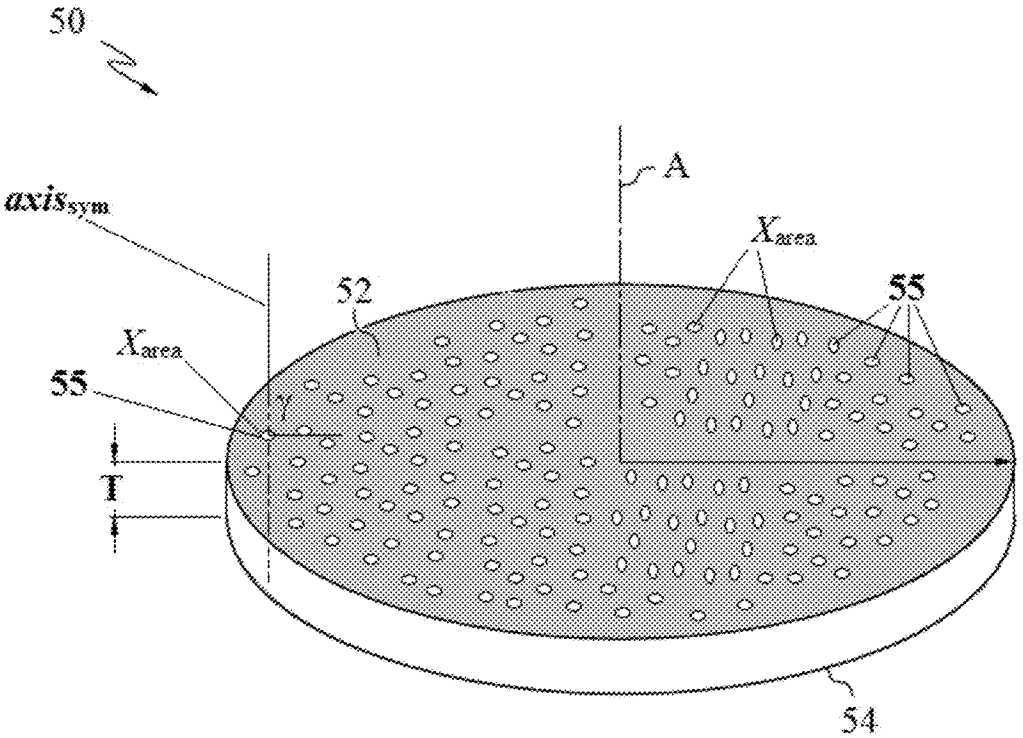
FIG. 3 is a depiction of a perspective view of a porous element disposed within a dynamic filtration device of the present invention.

Preferably, in the method of manufacturing high aspect ratio silver nanowires of the present invention, the porous element (50) used in the dynamic filtration device (10) has a plurality of passages (55) that traverse from the first side (35) of the cavity (30) to the second side (45) of the cavity (30); wherein the plurality of passages (55) are large enough to permit transfer of mother liquor and low aspect ratio silver particles and small enough to block transfer of high aspect ratio silver nanowires. More preferably, each passage (55), in the plurality of passages (55), has a cross sectional area, $X_{area}$, perpendicular to the flow of permeate through the thickness, T, of the porous element (50); wherein the cross sectional area, $X_{area}$, is substantially constant across the thickness, T, of the porous element (50). Preferably, the porous element (50) has a pore size rated at 1 to 10 μm (more preferably, 2 to 8 μm; still more preferably, 2 to 5 μm; most preferably, 2.5 to 3.5 μm). Preferably, the porous element is selected from curved porous elements and flat porous elements. More preferably, the porous element is a flat porous element. Preferably, in the method of manufacturing high aspect ratio silver nanowires of the present invention, the porous element (50) used in the dynamic filtration device (10) is a porous membrane. More preferably, the porous element (50) is a track etched polycarbonate (PCTE) membrane. (See FIGS. 1-3).

Preferably, in the method of manufacturing high aspect ratio silver nanowires of the present invention, shear stress is generated in the mother liquor present in the filtration gap, FG; wherein the shear stress induces sufficient movement in the mother liquor tangential to the top surface (52) of the porous element (50) to reduce or prevent blinding or fouling of the porous element. The shear stress is generated by a relative motion between the porous element (50) and the turbulence inducing element (60) adjacent to the filtration gap, FG.

Preferably, in the method of manufacturing high aspect ratio silver nanowires of the present invention, wherein the porous element (50) is stationary relative to the cavity (30), the turbulence inducing element (60) moves relative to the porous element (50). Preferably, when the porous element (50) is a stationary and flat porous element, the turbulence inducing element (60) rotates in a plane proximate the top surface (52) of the porous element (50). More preferably, when the porous element (50) is a flat, porous membrane; the turbulence inducing element (60) is an agitator. Preferably, the agitator is selected from the group consisting of a stir bar, a stir bar depending from and secured to (or integral with) a shaft, and an impeller mounted to a shaft. Preferably, the porous membrane is flat and has a top surface (52) and a bottom surface (54); wherein the top surface (52) and the bottom surface (54) are parallel; wherein the porous membrane has a thickness, T, measured from the top surface (52) to the bottom surface (54) along a line (A) normal to the top surface (52); and, wherein the top surface (52) faces the turbulence inducing element (60). Preferably, the turbulence inducing element (60) provided with the flat porous membrane is an agitator with an impeller; wherein the impeller is continuously rotated in a plane disposed in the first side (32) of the cavity (30). Preferably, the filtration gap is defined by the plane in which the impeller is continuously rotated and the top surface (52) of the porous element (50) proximate to the impeller (more preferably, wherein the plane is parallel to the top surface of the porous element). (See FIGS. 1-3).

Preferably, in the method of manufacturing high aspect ratio silver nanowires of the present invention, the turbulence inducing element has a permeable surface. More preferably, when the turbulence inducing element has a permeable surface, the permeable surface is interposed between the first side of the cavity and the second side of the cavity and at least some of the permeate withdrawn from the dynamic filtration device passes through the permeable surface of the turbulence inducing element from the first side of the cavity to the second side of the cavity. Preferably, when the turbulence inducing element has a permeable surface, the permeable surface of the turbulence inducing element faces the plurality of passages of the porous element. Preferably, when the turbulence inducing element has a permeable surface, the permeable surface is curved and disposed about a central axis of rotation; wherein the turbulence inducing element rotates about the central axis. More preferably, when the turbulence inducing element has a curved permeable surface, disposed about a central axis of rotation; wherein the turbulence inducing element rotates about the central axis; the porous element also has a curved surface disposed about a central axis of rotation; wherein the porous element curved surface has a plurality of passages that traverse from the first side of the cavity to the second side of the cavity; wherein the porous element rotates about its central axis; wherein the turbulence inducing element curved permeable surface faces the porous element curved surface; wherein the space interposed between the turbulence inducing element curved permeable surface and the porous element curved surface defines the filtration gap, FG. Preferably, the central axis of rotation of the turbulence inducing element and that of the porous element are parallel. Preferably, the turbulence inducing element and the porous element rotate in the same direction. Preferably, the turbulence inducing element and the porous element counter rotate.

Figure 4:
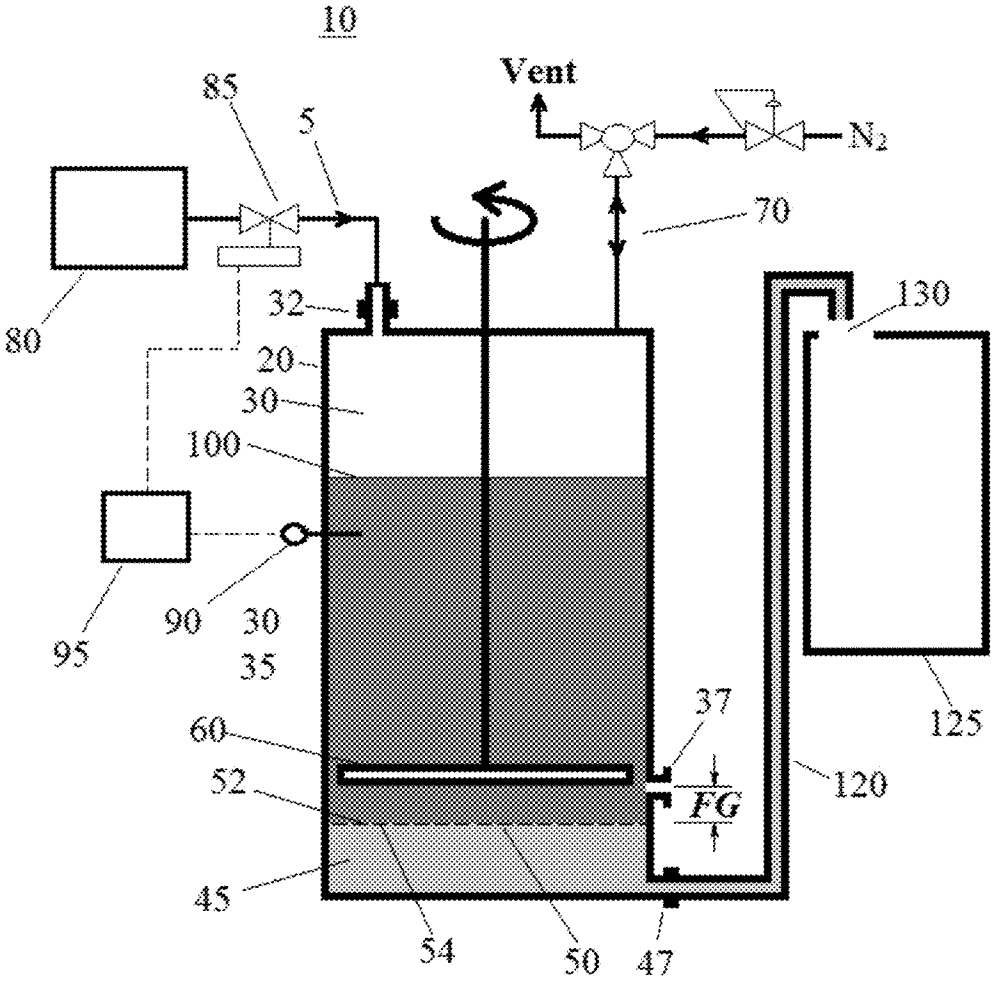
FIG. 4 is a depiction of a dynamic filtration device of the present invention with an associated permeate container.

Preferably, in the method of manufacturing high aspect ratio silver nanowires of the present invention, the filtration gap, FG, is disposed in the filter housing and is interposed between the first side (35) of the cavity (30) and the second side (45) of the cavity (30); wherein the filtration gap, FG, is defined by two opposing surfaces; wherein at least one of the opposing surfaces is moveable; and, wherein the porous element (50) provides at least one of the opposing surfaces. The filtration gap, FG, is typically formed between oppositely disposed, facing surface that are spaced apart by a distance of 1 to 25 mm (preferably, 1 to 20 mm; more preferably, 1 to 15 mm; most preferably, 1 to 10 mm). Preferably, the size of the filtration gap, FG, is substantially constant across the opposing surface provided by the porous element (50) (i.e., wherein the largest filtration gap size, $FGS_L$, and the smallest filtration gap size, $FGS_S$, between the opposing surfaces are related as follows: $0.9\ FGS_L \leq FGS_S \leq FGS_L$). (See FIGS. 1, 4 and 5).

Preferably, in the method of manufacturing high aspect ratio silver nanowires of the present invention, at least one of the porous element (50) and the turbulence inducing element (60) moves relative to each other to generate a shear stress in the mother liquor in a filtration gap, FG, between opposing surfaces of the porous element (50) and the turbulence inducing element (60). More preferably, at least one of the porous element (50) and the turbulence inducing element (60) moves continuously relative to other to generate a shear stress in the mother liquor in a filtration gap, FG, between opposing surfaces of the porous element (50) and the turbulence inducing element (60). Preferably, the shear stress generated in the filtration gap, FG, induces sufficient movement in the mother liquor tangential to the surface of the porous element facing the first side (35) of the cavity (30) to reduce or prevent blinding or fouling of the porous element. Preferably, the porous element (50) and the turbulence inducing element (60) move relative to each other at a relative velocity of 0.4 to 1.5 m/s (more preferably, 0.6 to 1.3 m/s; most preferably, 0.9 to 1.1 m/s).

Preferably, the shear stress generated in the mother liquor disposed within the filtration gap, FG, and the pressure drop across the porous element from the first side of the cavity to the second side of the cavity are decoupled. Most preferably, the shear stress generated in the mother liquor disposed within the filtration gap, FG, and the pressure drop across the porous element from the first side of the cavity to the second side of the cavity are independently controllable.

Preferably, in the method of manufacturing high aspect ratio silver nanowires of the present invention, the pressure source provides the primary motive force for the passage of permeate through the porous element to the second side of the cavity. Preferably, the pressure source is a gas pressure exerted on the first side of the cavity. More preferably, the gas pressure exerted on the first side of the cavity is an inert gas. Most preferably, the gas pressure exerted on the first side of the cavity is nitrogen. The gas pressure can be applied to the first side of the cavity in the form of a gaseous head space above the liquid level in the cavity. Alternatively, the first side of the cavity provided may further comprise a bladder; wherein the bladder is pressurized with the gas. Preferably, the pressure source induces a pressure drop across the porous element of 5 to 70 kPA (preferably, 10 to 55 kPa; more preferably, 15 to 40 kPa; most preferably, 20 to 35 kPa).

Preferably, the method of manufacturing high aspect ratio silver nanowires of the present invention, further comprises: periodically providing a reverse flow through the porous element (50) from the second side (45) of the cavity (30) to the first side (35) of the cavity (30). One of ordinary skill in the art will know to select appropriate means for providing the reverse flow. More preferably, the method of manufacturing high aspect ratio silver nanowires of the present invention, further comprises: periodically providing a reverse flow through the porous element (50) from the second side (45) of the cavity (30) to the first side (35) of the cavity (30); wherein the reverse flow is provided for a period of 1 to 10 seconds (more preferably, of 2.5 to 7.5 seconds;

most preferably, of 3 to 5 seconds) every 10 to 60 seconds (more preferably, 15 to 40 seconds; most preferably, 20 to 30 seconds).

Preferably, the method of manufacturing high aspect ratio silver nanowires of the present invention, further comprises: providing a conduit (120) for transferring permeate from the at least one outlet (47) from the second side (45) of the cavity (30) to a container (125) (preferably, wherein there is an air gap (130) between conduit (120) and the container (125)). More preferably, the method of manufacturing high aspect ratio silver nanowires of the present invention, further comprises: providing a conduit (120) for transferring permeate from the at least one outlet (47) from the second side (45) of the cavity (30) to a container (125) (preferably, wherein there is an air gap (130) between conduit (120) and the container (125)); and, periodically, momentarily depressurizing the first side (35) of the cavity (30) by relieving the pressure source (70) (e.g., venting the first side of the cavity to atmosphere); wherein the conduit (120) holds a volume of permeate that is at an elevation that is higher than that of the liquid level (100) in the dynamic filtration device (10) (preferably, wherein the volume of permeate that is at an elevation that is higher than that of the liquid level (100) has a head of 20 to 500 mm (more preferably, 100 to 375 mm; most preferably, 150 to 300 mm) such that when periodically, momentarily depressurizing the first side (35) of the cavity (30) there is a reversal of flow through the porous element (50) from the second side (45) of the cavity (30) to the first side (35) of the cavity (30). Preferably, the periodic, momentary depressurizing is provided for a period of 1 to 10 seconds (more preferably, of 2.5 to 7.5 seconds; most preferably, of 3 to 5 seconds) every 10 to 60 seconds (more preferably, 15 to 40 seconds; most preferably, 20 to 30 seconds) of pressurizing. (See FIGS. 4-5).

Preferably, the method of manufacturing high aspect ratio silver nanowires of the present invention, further comprises: providing a vibrational energy source; and, periodically applying vibrational energy from the vibrational energy source to the porous element.

Preferably, the method of manufacturing high aspect ratio silver nanowires of the present invention, further comprises: providing an ultrasonic energy source; and, periodically applying ultrasonic energy from the ultrasonic energy source to the porous element.

Preferably, the method of manufacturing high aspect ratio silver nanowires of the present invention, provides a volumetric flux of permeate through the porous element of 20 to 1,000 $L/m^2 \cdot hour$ (more preferably, 140 to 540 $L/m^2 \cdot hour$; most preferably, 280 to 360 $L/m^2 \cdot hour$).

Preferably, the method of manufacturing high aspect ratio silver nanowires of the present invention, provides a product, wherein the silver solids in the product have an average diameter of ≤40 nm (preferably, 20 to 40 nm; more preferably, 20 to 35; most preferably, 20 to 30 nm). More preferably, the method of manufacturing high aspect ratio silver nanowires of the present invention, provides a product, wherein the silver solids in the product have an average diameter of ≤40 nm (preferably, 20 to 40 nm; more preferably, 20 to 35; most preferably, 20 to 30 nm) and an average length of 10 to 100 μm. Preferably, the silver solids in the product have an average aspect ratio of >500.

Preferably, the method of manufacturing high aspect ratio silver nanowires of the present invention, provides a product, wherein the silver solids in the product have a diameter standard deviation of ≤26 nm (preferably, 1 to 26 nm; more preferably, 5 to 20 nm; most preferably, 10 to 15 nm). More preferably, the method of manufacturing high aspect ratio silver nanowires of the present invention, provides a product, wherein the silver solids in the product have an average diameter of ≤40 nm (preferably, 20 to 40 nm; more preferably, 20 to 35; most preferably, 20 to 30 nm) with a diameter standard deviation of ≤26 nm (preferably, 1 to 26 nm; more preferably, 5 to 20 nm; most preferably, 10 to 15 nm). Most preferably, the method of manufacturing high aspect ratio silver nanowires of the present invention, provides a product, wherein the silver solids in the product have an average diameter of ≤40 nm (preferably, 20 to 40 nm; more preferably, 20 to 35; most preferably, 20 to 30 nm) with a diameter standard deviation of ≤26 nm (preferably, 1 to 26 nm; more preferably, 5 to 20 nm; most preferably, 10 to 15 nm) and an average length of 10 to 100 μm.

Preferably, the method of manufacturing high aspect ratio silver nanowires of the present invention, provides a product, wherein $WF_{Raw}<WF_{Product}$. More preferably, the method of manufacturing high aspect ratio silver nanowires of the present invention, provides a product, wherein $WF_{Raw}<WF_{Product}\geq 0.8$. Still more preferably, the method of manufacturing high aspect ratio silver nanowires of the present invention, provides a product, wherein $WF_{Raw}<WF_{Product}\geq 0.85$. Most preferably, the method of manufacturing high aspect ratio silver nanowires of the present invention, provides a product, wherein $WF_{Raw}<WF_{Product}\geq 0.9$.

Some embodiments of the present invention will now be described in detail in the following Examples.

The water used in the following Examples was obtained using a ThermoScientific Barnstead NANOPure purification system with a 0.2 μm pore size hollow fiber filter positioned downstream of the water purification unit.

Comparative Example A

A Sterlitech filtration cell with a 3 μm track-etched membrane was used to filter 250 mL of a raw feed solution, wherein the raw feed solution was a 0.2 wt % silver containing polyol solution. The raw feed solution was passed through the filtration cell using a Masterflex® peristaltic pump at a volumetric rate of 400 mL/min. Every five minutes, water was back flushed through the filtration cell. The retentate collected was passed through the filtration cell five more times to provide the product solution. ImageJ analysis was used to determine the area of particles versus wires provided in TABLE 1, where low aspect ratio particles were those classified as having an aspect ratio of less than 3. The diameter data provided in TABLE 1 were determined from scanning electron microscopy (SEM) images obtained from samples prepared by vacuum drying a drop of solution on a silicon wafer using an FEI Nova NanoSEM field emission gun scanning electron microscope using FEI's Automated Image Acquisition (AIA) program. At least 100 discrete wires on the images were measured in ImageJ for their diameter. It was noted that the length of the silver nanowires in the product solution appeared shorter than that of the silver nanowires in the raw feed solution, which suggests that the silver nanowires in the raw feed solution were damaged during the filtration process.

TABLE 1

| | | Diameter | |
|---|---|---|---|
| Solution | wire area/(wire area + particle area) | Mean (nm) | SD (nm) |
| Raw Feed | 0.83 | 53 | 16 |
| Product | 0.92 | 60 | 20 |

Example 1

Aqueous feed solutions containing silver solids including both high aspect ratio silver nanowires and low aspect ratio silver particles were filtered using an Advantec/MFS model UHP 150 stirred cell filter housing with a filtering area of 162 $cm^2$ and outfitted with a magnetic cylindrical rod impeller. The filter housing was placed on a Mettler model SB32001DR balance/magnetic stirring apparatus. The porous medium used was a 5 μm hydrophilic polycarbonate track-etched (PCTE) filter membrane supported in the bottom of the filter housing. Nitrogen pressure was used to provide the motive force for producing a pressure drop across the porous medium. Nitrogen was supplied to the headspace in the filter housing. The pressure in the headspace was measured using a Cole-Parmer model 68075-16 pressure transducer. The nitrogen fed to the filter housing was passed through a three way ball valve mounted on the top of the filter housing. The three way valve enabled the periodic halting of the nitrogen flow and the periodic relieving of the pressure in the head space of the filter housing to atmosphere. This allowed for a gravity-induced reverse flow of filtrate material from the discharge line back into the filter housing up through the filter membrane. The three-way valve was controlled using a Camille process control computer such that every 25 seconds, the nitrogen supply to the filter housing was halted and the filter housing was vented to atmosphere for 5 seconds before reinstituting the nitrogen supply. A weighed amount of raw feed was poured into the filter housing. A transport fluid was supplied to the filter housing using a Masterflex model 77800-16 Easy-Load 3 peristaltic pump with digital drive and size 16 C-Flex hose. The volume of transport fluid transferred to the filter housing was manually controlled to maintain a steady level in the filter housing throughout the filtration process. The filtrate exiting the bottom of the filter housing was passed upward through a 4.1 mm ID flexible plastic tube into the top of an open top container. The fluid head in the filtrate tube provided the driving force for the back flow into the filter housing when the head space was periodically opened to atmosphere with the three-way valve. The silver solids in the raw feed and in the product filtrate were analyzed in the same manner as Comparative Example A. The results are provided in TABLE 2. It was noted that the length of the silver nanowires in the product solution did not appear to have been compromised during the filtration process, as was the case in Comparative Example A.

TABLE 2

| | | Diameter | | |
|---|---|---|---|---|
| Solution | wire area/(wire area + particle area) | Mean (nm) | Median (nm) | SD (nm) |
| Raw Feed | 0.759 | 60.1 | 43.6 | 45.9 |
| Product | 0.998 | 39.6 | 38.9 | 9.8 |

We claim:

1. A method of manufacturing high aspect ratio silver nanowires, comprising:

providing a raw feed, comprising:

a mother liquor; and, silver solids;

wherein the silver solids in the raw feed include high aspect ratio silver nanowires and low aspect ratio silver particles;

providing a dynamic filtration device, wherein the dynamic filtration device, comprises:

a housing, comprising: a cavity having a first side and a second side;

wherein there is at least one inlet to the first side of the cavity, at least one product outlet from the first side of the cavity and at least one permeate outlet from the second side of the cavity; and, a porous element disposed within the cavity;

a turbulence inducing element disposed within the cavity; and, a pressure source;

wherein the porous element is interposed between the first side of the cavity and the second side of the cavity; wherein the porous element has a plurality of passages that traverse from the first side of the cavity to the second side of the cavity; wherein the plurality of passages are large enough to permit transfer of the mother liquor and low aspect ratio silver particles and small enough to block transfer of the high aspect ratio silver nanowires;

wherein the porous element and the turbulence inducing element cooperate to form a filtration gap, FG; and, wherein at least one of the porous element and the turbulence inducing element is moveable;

transferring the raw feed to the dynamic filtration device through the at least one inlet to the first side of the cavity; wherein the filtration gap, FG, is filled by the mother liquor; wherein the porous element and the turbulence inducing element disposed within the cavity are both in contact with the mother liquor;

pressurizing the first side of the cavity using the pressure source resulting in a first side pressure, $FS_P$, in the first side of the cavity; wherein the first side pressure, $FS_P$, is higher than a second side pressure, $SS_P$, in the second side of the cavity, whereby there is created a pressure drop across the porous element from the first side of the cavity to the second side of the cavity; wherein the pressure source provides a primary motive force for inducing a flow from the first side of the cavity through the porous element to the second side of the cavity providing a permeate;

moving at least one of the porous element and the turbulence inducing element whereby a shear stress is generated in the mother liquor in the filtration gap, FG; wherein the shear stress generated in the mother liquor in the filtration gap, FG, operates to reduce fouling of the porous element;

withdrawing the permeate from the at least one permeate outlet from the second side of the cavity, wherein the permeate comprises a second part of the mother liquor and a second portion of the silver solids; wherein the second portion of the silver solids is rich in low aspect ratio silver particles; and, withdrawing a product from the at least one product outlet from the first side of the cavity, wherein the product comprises a first part of the mother liquor and a first portion of the silver solids; wherein the first portion of the silver solids is depleted in low aspect ratio silver particles; and, wherein the shear stress generated in the mother liquor in the filtration gap, FG, and the pressure drop across the porous element from the first side of the cavity to the second side of the cavity are decoupled.

2. The method of claim 1, further comprising:

providing a transport fluid; and, transferring a volume of the transport fluid to the dynamic filtration device through the at least one inlet to the first side of the cavity.

3. The method of claim 2, further comprising:

continuously moving the turbulence inducing element relative to the porous element.

4. The method of claim 3, wherein the turbulence inducing element provided is an agitator with an impeller; and, wherein the impeller is continuously rotated in a plane disposed in the first side of the cavity.

5. The method of claim 4, wherein the porous element is a porous membrane;

wherein the porous membrane is flat and has a top surface and a bottom surface; wherein the top surface and the bottom surface are parallel; wherein the porous membrane has a thickness, T, measured from the top surface to the bottom surface along a line (A) normal to the top surface;

and, wherein the top surface is proximate to the turbulence inducing element.

6. The method of claim 5, wherein each passage in the plurality of passages has a cross sectional area parallel to the top surface; wherein the cross sectional area is uniform across the thickness, T, of the porous membrane.

7. The method of claim 6, wherein the filtration gap, FG, is defined by the plane and the top surface of the porous element proximate to the impeller.

8. The method of claim 7, wherein the filtration gap, FG, is 1 to 100 mm.

9. The method of claim 8, wherein a volumetric flux of permeate through the porous element is 280 to 360 $L/m^2 \cdot hour$.

10. The method of claim 9, wherein the pressure drop across the porous element is 20 to 35 kPa.

* * * * *